US005746265A

United States Patent [19]

Hoyt et al.

[11] Patent Number: 5,746,265

[45] Date of Patent: May 5, 1998

[54] LANYARD FOR GOLF CLUB HEAD COVERS

[75] Inventors: David Hoyt; Gary T. Aldcroft, both of Los Angeles, Calif.

[73] Assignee: Principle Plastics, Inc., Gardena, Calif.

[21] Appl. No.: 529,364

[22] Filed: Sep. 18, 1995

[51] Int. Cl.[6] ..... B65D 65/22

[52] U.S. Cl. ..... 150/160; 206/315.4

[58] Field of Search ..... 150/154, 160; 206/315.4; 220/23.4, 375, 23.2; 24/713, 713.1, 300

[56] References Cited

U.S. PATENT DOCUMENTS

| | | | |
|---|---|---|---|
| 1,934,334 | 11/1933 | Schumann | 220/375 |
| 2,141,801 | 12/1938 | Taft | 24/713 |
| 2,532,195 | 11/1950 | Rosenow et al. | 150/160 |
| 2,800,696 | 7/1957 | Aicher | 24/300 |
| 3,145,749 | 8/1964 | Rosenow | 150/160 |
| 3,294,138 | 12/1966 | Pawly | 150/160 |
| 4,213,614 | 7/1980 | Phillippi | 150/160 X |
| 4,762,241 | 8/1988 | Lang | 215/378 X |
| 4,867,337 | 9/1989 | Eichenseer | 220/375 |
| 5,062,184 | 11/1991 | Rowland | 24/300 X |

*Primary Examiner*—Allan N. Shoap
*Assistant Examiner*—Christopher J. McDonald
*Attorney, Agent, or Firm*—John J. Connors; Connors & Assoc.

[57] ABSTRACT

A lanyard connects a pair of head covers for golf clubs together by a connector section of predetermined thickness with a hole therein for receiving the lanyard. The lanyard includes an elongated line element having opposed ends with a pair of protruding members near each of these opposed ends. Each pair of protruding members has an outer most and and inner most member which are spaced apart a distance about equal to the predetermined thickness of the connector section. One end of the line element has a tab section that extends from an adjacent outer most protruding member nearby the one end of the line element which facilitates pulling the adjacent outer most protruding member through one hole in one cover. The other end of the line element has another tab section that extends from an adjacent outer most protruding member nearby this other end of the line element which facilitates pulling the adjacent outer most protruding member through this other hole in the other cover. The protruding members are larger than the holes and the connector section and protruding members are made of an elastic material, so that deformation of the protruding members and stretching of the connector section occurs as an outer most protruding member is pulled through a hole.

10 Claims, 2 Drawing Sheets

FIG. 2
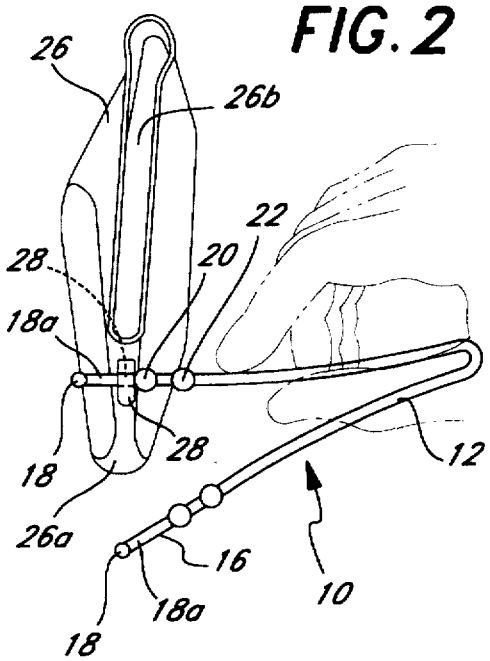
FIG. 3
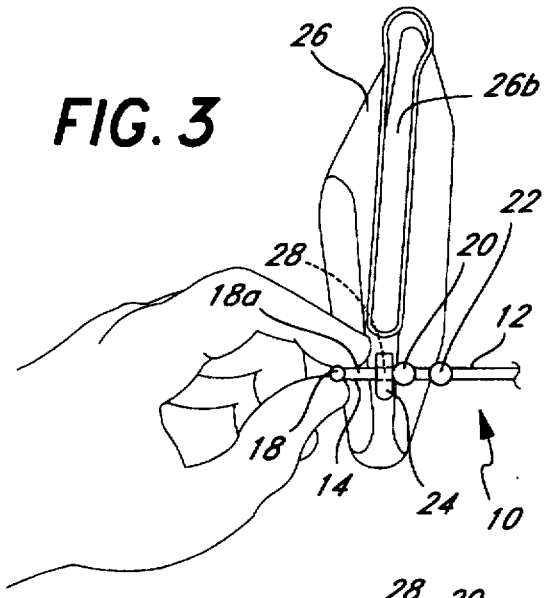
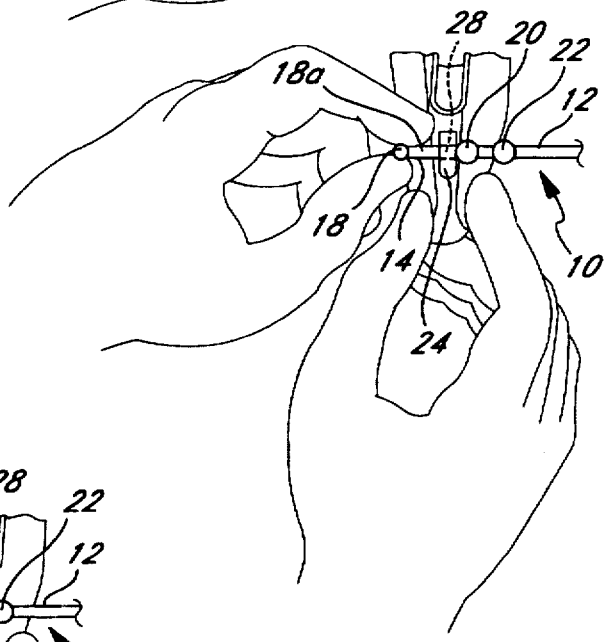
FIG. 4
FIG. 5
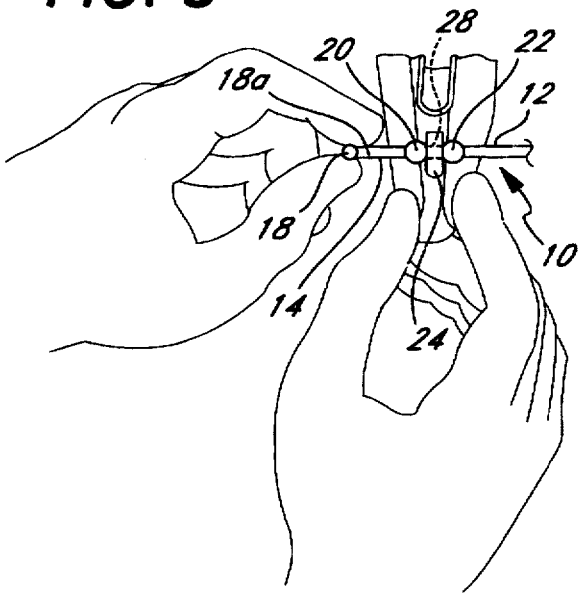
FIG. 6
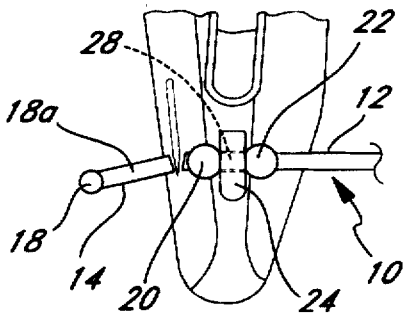

LANYARD FOR GOLF CLUB HEAD COVERS

BACKGROUND OF THE INVENTION

1. Field of the Invention

This invention relates to a unique lanyard for connecting together a pair of golf club head covers, and in particular, to a lanyard which is easy to manufacture from plastic materials, is convenient to use, and which avoids entanglement.

2. Background Discussion

Head covers, for example, of the type disclosed in U.S. patent application Ser. No. 08/434,517, filed May 4, 1995, and entitled Enlarged Iron Cover, assigned to the same assignee as the present invention and incorporated herein by reference and made a part of this application, are used to cover the heads of golf clubs, in particular, the irons. Sometimes a lanyard, that is, a string or line, is used to ties the head covers together. Typically, one long lanyard is used to connect three or even more of the head covers together. The lanyard frequently becomes entangled, and most golfers find lanyards too cumbersome or inconvenient to use, and therefore, do not ordinarily tie the head covers together.

SUMMARY OF THE INVENTION

The lanyard of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its benefits, which include convenience of use, low cost manufacture, and prevention of loss of head covers by tying a pair of head covers together with the lanyard of this invention.

The first feature of this invention is that it provides an easy-to-use lanyard which ties together only two head covers. Each cover has a closed end and spaced therefrom an open mouth through which the head of a golf cub is inserted into a cavity in the cover. A connector section is preferably along an inside edge of the cover extending between the closed end and the open mouth. There is a hole in each connector section for receiving the lanyard which ties the pair of covers together. Thus, when the golfer removes the head cover from one golf club, the removed cover will be suspended by the lanyard from an adjacent head cover to which it is tied.

The second feature is that the lanyard has opposed ends with a pair of protruding members near each of the opposed ends. One end of the lanyard is pulled through the hole in one of the covers and the other end of the lanyard is pulled through the hole in the other covers. Each pair of protruding members is spaced apart a short distance. The protruding members at one end of the lanyard straddle the hole in the connector section of one of the covers and the protruding members at the other end of the lanyard straddle the hole in the connector section of the other cover.

The third feature is that the protruding members are larger than the hole in the connector sections of the covers, and the connector sections and the protruding members are made of an elastic material, so that deformation of the protruding members and stretching of the connector sections occurs as a protruding member is pulled through a hole. Preferably, the cover is made of a polymeric material and the lanyard is made of thermal plastic rubber. The polymeric material may be, for example, polyvinyl chloride plastisol. Preferably, the lanyard is an elongated line element that is bend approximately at a central section thereof so that it has a substantially V-shaped configuration. This configuration facilitates molding of the lanyard from the thermal plastic rubber.

The fourth feature is that that there is a tab section that extends from the outer most protruding members which facilitates pulling these outer most protruding members through the holes in the connector sections of the covers. The tab section is severed close to the outer most protruding member after pulling the outer most protruding member through the hole.

The fifth feature is that the protruding members are substantially spherical in configuration having a diameter between 0.150 and 0.350 inch, typically 0.250 inch, and the holes are substantially circular in configuration having a diameter between 0.075 and 0.250 inch, typically 0.175 inch.

DESCRIPTION OF THE DRAWING

The preferred embodiment of this invention, illustrating all its features, will now be discussed in detail. This embodiment depicts the novel and non-obvious lanyard of this invention as shown in the accompanying drawing, which is for illustrative purposes only. This drawing includes the following figures (FIGS.), with like numerals indicating like parts:

FIG. 2 is a top plan view showing one end of the lanyard being inserted by a golfer into a connector section of a head cover for a golf club.

FIG. 3 is a top plan view showing a golfer grasping the portion of the tab section of the lanyard extending through a hole in the connector section of the head cover.

FIG. 4 is a top plan view showing the golfer using both hands to pull an outer most protruding member through the hole in the connector section of the cover, one hand to grasp the tab section of the lanyard and the other hand to grasp the head cover to pull the end of the lanyard through the connector section.

FIG. 5 is a top plan view showing the end of the lanyard pulled through the connector section of the cover, with the pair of protruding members straddling the connector section.

FIG. 6 a top plan view showing the tab section of the lanyard being severed.

DESCRIPTION OF THE PREFERRED EMBODIMENT

Figure 1A:
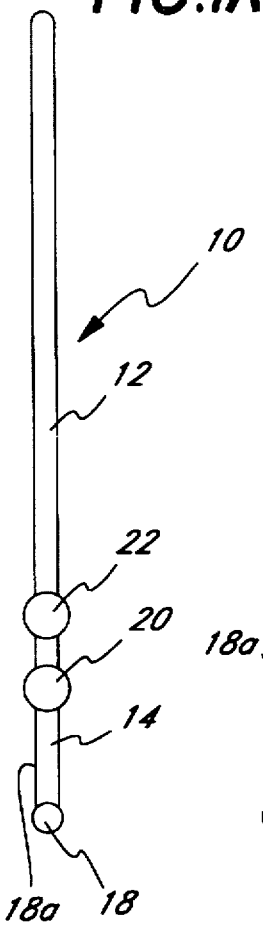
FIG. 1A is a side-elevational view of the lanyard of this invention.
Figure 1B:
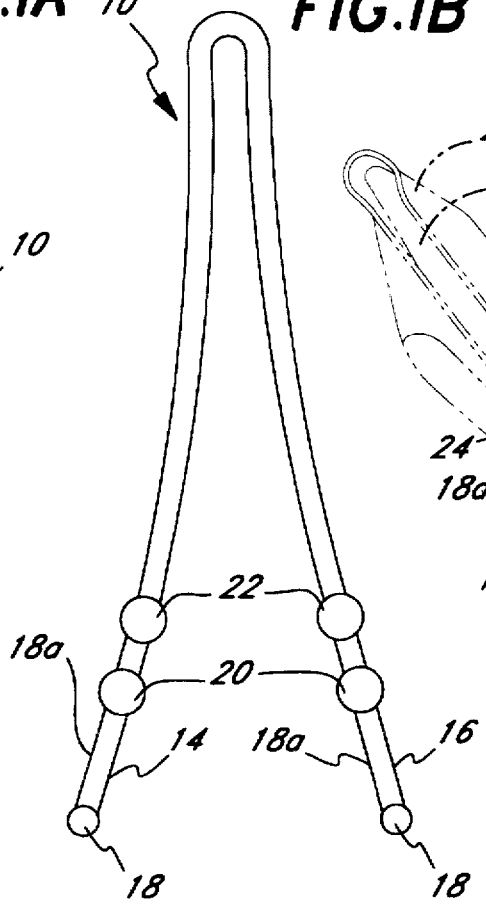
FIG. 1B is a front-elevational view of the lanyard of this invention.

As best shown in FIGS. 1A and 1B, the lanyard 10 of this invention comprises an elongated line element 12 having a pair of opposed ends 14 and 16. At each end 14 and 16 is a tab section 18*a* terminating in a ball element 18, and nearby each end is a pair of protruding members, an outermost protruding member 20 and the innermost protruding member 22. Each pair of protruding members 20 and 22 is spaced apart a relatively small distance, which is approximately equal to the thickness of a connector section 24 of a golf club head cover 26 (FIG. 2).

Figure 8:
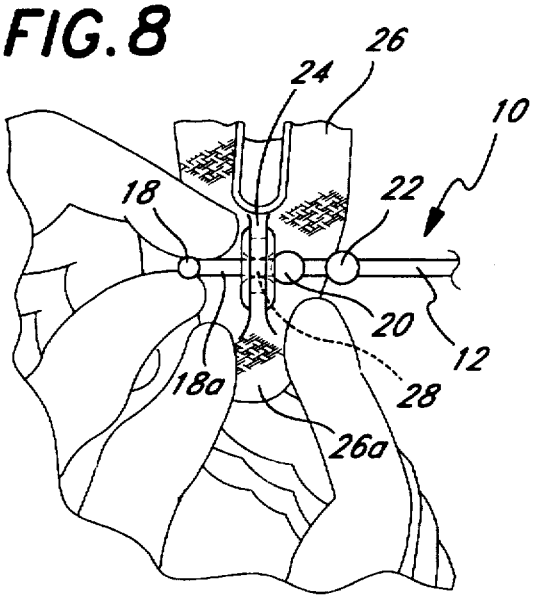
FIG. 8 is an enlarged, fragmentary view of a portion of FIG. 4.
Figure 9:
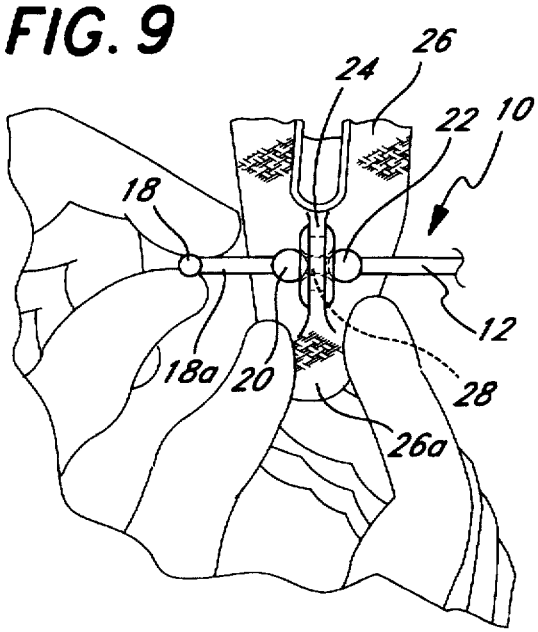
FIG. 9 is an enlarged, fragmentary view of a portion of FIG. 5.

As best shown in FIGS. 2 and 3, the head cover 26 includes a closed end 26*a*, and remote from this closed end, an elongated, open mouth 26*b* through which the golf club (not shown) is inserted into a cavity (not shown) inside the cover. The connector section 24 is disposed along an inside edge of the cover 26 that extends between the closed end 26*a* and the open mouth 26*b*, and it has a small diameter hole 28 therein. The head cover 26 preferably is made from a polymeric material which is elastic such as, for example, polyvinyl chloride plastisol with a Shore A durometer between about 40 and about 80. The connector section 24 is integral with the other sections of the head cover 26 and is made of the same elastic material. As illustrated in FIGS. 8 and 9, this enables the hole 28 in the connector section 24 to become enlarged slightly as the outer most protruding member 20 is forced through this hole during connection of the lanyard 10 to the head cover 26.

As best shown in FIG.1B, the lanyard 10 is an integral one-piece, preferably V-shaped structure, which is injected molded from an elastic material such as, for example, thermal plastic rubber. This is desirable because it enables a mold to be made in a fashion that maximizes the production of lanyards from one mold. The typical length of the lanyard 10 ranges between 6 and 14 inches. The diameter of the line element 12 ranges between 0.060 and 1.90 inches. Typically, the spacing between the protruding members 20 and 22 (center to center) ranges between 0.090 and 0.500 inch, and preferably, the protruding members 20 and 22 are spherical in shape. The diameters of the protruding members are about twice as large as the diameter of the hole 28, and the diameter of the hole typically is about 0.175 inch.

As best shown in FIGS. 2 through 5, the golfer first inserts one end 14 of the lanyard 10 through the hole 28 in the connector section 24 of the head cover 26. As depicted in FIG. 3, the golfer grasps the ball 18 at one end of the lanyard 10 with one hand and, as shown in FIG. 4, grasps the cover 26 with his or her other hand, and then pulls the outermost protruding member 20 through the hole 28. Both the outermost protruding member 20 and the hole 28 deform as the protruding member is forced through the hole. When the outermost protruding member 20 exits the hole 28, the hole contracts and the outermost protruding member 20 and the innermost protruding member 22 straddle the hole and the connector section 24, as depicted in FIG. 5. When this is accomplished, the golfer simply trims the tab section 18*a* away by severing it with a scissors or knife, as depicted in FIG. 6.

Figure 7:
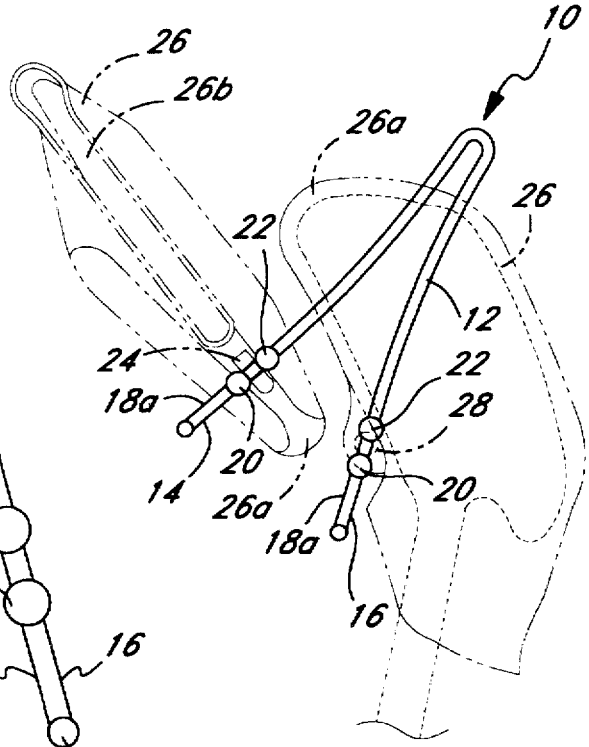
FIG. 7 is a perspective view of a pair of head covers connected together using the lanyard of this invention.

The golfer takes the other end 16 of the lanyard 10 and repeats the process depicted in FIGS. 2 through 5 to connect this other end 16 of the lanyard 10 to the second head cover, as illustrated in FIG. 7. Thus, the golfer may remove one head cover, which is free to dangle from the other head cover.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

We claim:

1. The combination, including a pair of head covers for golf clubs, each cover having a connector section with a hole therein for receiving a lanyard which ties the pair of covers together, and said lanyard having opposed ends with a pair of protruding members near each of said opposed ends, one end of the lanyard being pulled through the hole in one of said covers and the other end of said lanyard being pulled through the hole in the other of said covers, each pair of protruding members being spaced apart a short distance, with the protruding members at one end of the lanyard straddling the hole in the connector section of one of the covers and the protruding members at the other end of the lanyard straddling the hole in the connector section of the other cover, each pair of protruding members being larger than the hole they straddle, said connector section and the protruding members being made of an elastic material, so that deformation of the protruding members and stretching of the connector section occurs as a protruding member is pulled through a hole.

2. The combination of claim 1 where the cover is made of a polymeric material and the lanyard is made of thermal plastic rubber.

3. The combination of claim 2 where the polymeric material is a polyvinyl chloride.

4. The combination of claim 1 where the protruding members are substantially spherical in configuration having a diameter between 0.150 and 0.350 inch, and the holes are substantially circular in configuration having a diameter between 0.075 and 0.250 inch.

5. The combination of claim 1 where there is a tab section that extends from an outer most protruding member which facilitates pulling the outer most protruding member through a hole.

6. The combination of claim 1 where the cover has a closed end and spaced therefrom an open mouth through which the head of a golf cub is inserted into a cavity in the cover, said connector section being along an inside edge of the cover extending between the closed end and the open mouth.

7. The combination, including a pair of head covers for golf clubs, each cover having a connector section of predetermined thickness with a hole therein for receiving a lanyard which ties the pair of covers together, and said lanyard having opposed ends with a pair of protruding members near each of said opposed ends, each pair of protruding members having an outer most and inner most member which are spaced apart a distance about equal to said predetermined thickness of said connector section, one end of the lanyard having a tab section that extends from an adjacent outer most protruding member nearby said one end of the lanyard which facilitates pulling only said adjacent outer most protruding member through one hole in one cover, and the other end of the lanyard having another tab section that extends from an adjacent outer most protruding member nearby said other end of the lanyard which facilitates pulling only said adjacent outer most protruding member through the other hole in the other cover, said protruding members being larger than the holes and the connector section and protruding members being made of an elastic material, so that deformation of the protruding members and stretching of a connector section occurs as an outer most protruding member is pulled through a hole, and said protruding members at said one end of the lanyard straddling the hole in the connector section of the one cover and said protruding members at the other end of the lanyard straddling the hole in the connector section of the other cover.

8. The combination of claim 7 where the cover is made of a polymeric material and the lanyard is made of thermal plastic rubber.

9. The combination of claim 8 where the polymeric material is a polyvinyl chloride.

10. The combination of claim 7 where the protruding members are substantially spherical in configuration having a diameter between 0.150 and 0.350 inch, and the holes are substantially circular in configuration having a diameter between 0.075 and 0.250 inch.

* * * * *